US007363714B2

(12) United States Patent
Lüttgens

(10) Patent No.: US 7,363,714 B2
(45) Date of Patent: Apr. 29, 2008

(54) PENCIL SHARPENER

(75) Inventor: Fritz Lüttgens, Erlangen (DE)

(73) Assignee: Kum Limited, Trim, County Meath (IE)

( * ) Notice: Subject to any disclaimer, the term of this patent is extended or adjusted under 35 U.S.C. 154(b) by 0 days.

(21) Appl. No.: 11/480,710

(22) Filed: Jul. 3, 2006

(65) Prior Publication Data

US 2007/0044327 A1 Mar. 1, 2007

(30) Foreign Application Priority Data

Sep. 1, 2005 (EP) ..... 05019035

(51) Int. Cl.
*B43L 23/08* (2006.01)

(52) U.S. Cl. ..... 30/452; 30/457; 30/458

(58) Field of Classification Search ..... 30/451, 30/452, 453, 454, 457, 458, 459, 460, 461; 144/28.11; D19/73
See application file for complete search history.

(56) References Cited

U.S. PATENT DOCUMENTS

| | | | | |
|---|---|---|---|---|
| 359,026 | A * | 3/1887 | McKinnon | 30/452 |
| 362,669 | A | 5/1887 | Schrader | |
| 486,470 | A * | 11/1892 | Humphries | 30/458 |
| 511,338 | A * | 12/1893 | Koester | 30/455 |
| 1,479,921 | A * | 1/1924 | Miller | 30/457 |
| 1,728,523 | A | 9/1929 | Bierbach | |
| 2,642,044 | A * | 6/1953 | Mussguller | 30/452 |
| 5,167,071 | A | 12/1992 | Eisen | |
| 5,894,669 | A * | 4/1999 | Luttgens | 30/452 |
| 5,987,759 | A | 11/1999 | Nita | |
| 6,301,791 | B1 * | 10/2001 | Luttgens | 30/454 |
| 6,397,479 | B1 | 6/2002 | Lüttgens | |
| 7,225,547 | B2 * | 6/2007 | Luttgens | 30/457 |
| 2002/0005100 | A1 | 1/2002 | Lawson et al. | |
| 2006/0080846 | A1 * | 4/2006 | Luttgens | 30/451 |

FOREIGN PATENT DOCUMENTS

| | | | |
|---|---|---|---|
| DE | 28 51 486 | A1 * | 6/1980 |
| DE | 40 00 122 | A1 | 7/1991 |
| DE | 196 40 909 | A1 * | 4/1998 |
| DE | 199 52 039 | A1 | 5/2001 |
| DE | 101 02 092 | C1 | 2/2002 |

* cited by examiner

*Primary Examiner*—Hwei-Siu C. Payer
(74) *Attorney, Agent, or Firm*—Laurence A. Greenberg; Werner H. Stemer; Ralph E. Locher

(57) ABSTRACT

A pencil sharpener has at least two sharpener units, each with a sharpener body and a shaving blade. The sharpener bodies of adjacent sharpener units being connected integrally via film strips acting as a predetermined bending point and/or predetermined separating point. In a second variant, the pencil sharpener has a sharpener body and a shaving blade fastened thereon. The sharpener body has a guide sleeve with a bore defining a pencil-guiding channel for a pencil to be sharpened, and at least one flat supporting wing which projects approximately radially in cross section from the guide sleeve. In an end region of the supporting wing a functional element is provided for protecting or for working on the tip of the pencil.

15 Claims, 4 Drawing Sheets

PENCIL SHARPENER

BACKGROUND OF THE INVENTION

Field of the Invention

The invention relates to a pencil sharpener for sharpening a pencil, in particular a cosmetic pencil.

A sharpener is usually used in order to sharpen the core of the pencil and, in the process, to shave off any core casing which may be present in the region of the pencil tip. A sharpener customarily comprises an approximately cuboidal or wedge-shaped sharpener body into which a substantially circular-conical sharpening cone is introduced, as a guide for the pencil tip, such that its lateral surface is approximately tangent to an outer surface of the sharpener body. In the vicinity of this tangent, the sharpening cone is open, via a shaving-discharge slot, in the direction of the abutting outer surface of the sharpener body. A sharpener also comprises a shaving blade which is fastened on the sharpener body tangentially in relation to the lateral surface of the sharpening cone and projects into the shaving-discharge slot by way of a cutting edge, so that, when a pencil which has been pushed into the sharpening cone is rotated in relation to the sharpener body, a shaving is removed from the pencil by the cutting edge of the shaving blade.

In the case of a so-called multiple sharpener, a plurality of sharpener units each with a sharpener body and a shaving blade fitted thereon are integrated to form a single structural unit. The sharpener units of such a multiple sharpener are usually designed differently in respect of the diameter of the pencil-guiding channel or of the opening angle of the sharpening cone, in order for it to be possible to sharpen pencils of different diameters and/or in order to fashion different tip shapes.

U.S. Pat. No. 5,167,071 and its counterpart German published patent application DE 40 00 122 A1 disclose a pencil sharpener wherein the substantially cuboid sharpener body is provided with complementary protrusions or depressions on its longitudinal side walls. The protrusions or depressions here allow a plurality of pencil sharpeners to be plugged together and thus to be combined to form a multiple sharpener.

Pencil sharpeners for sharpening cosmetic pencils, which are usually provided with a comparatively soft, plastic core, often have, in addition to the shaving blade, a so-called core former by means of which, during the sharpening operation, the core substance produced in the region of the pencil tip is formed into a predetermined, in particular rounded tip. A pencil sharpener which is known from German published patent application DE 199 52 039 A1 has a plurality of differently shaped core shapers which are arranged on a carousel-like adjustment mechanism and, by virtue of the adjustment mechanism being rotated, can alternatively be brought into engagement with the pencil-guiding channel.

SUMMARY OF THE INVENTION

It is accordingly an object of the invention to provide a sharpener, which overcomes the above-mentioned disadvantages of the heretofore-known devices and methods of this general type and which is particularly favorable in production terms, yet is intended to be flexible to use and/or easy to handle.

With the foregoing and other objects in view there is provided, in accordance with the invention, a pencil sharpener, comprising:

at least one sharpener body formed with at least one film strip defining a predetermined bending or separating point configured to enable at least one of the following:

at least one part of said sharpener body can be bent;

at least one part of said sharpener body can be detached;

one sharpener body can be bent relative to another said sharpener body;

one sharpener body can be detached from another said sharpener body.

In other words, the objects of the invention are achieved, in a first variant of the invention, by a pencil sharpener that comprises at least two sharpener units, of which each has a sharpener body and a shaving blade fastened thereon. In this case, the sharpener bodies of adjacent sharpener units are connected integrally via a film strip, i.e. a material strip which is thin-walled in comparison with each sharpener body, and is therefore flexible, and, in the manner of a film hinge, acts as a predetermined bending point or predetermined separating point.

The fact that the plurality of sharpener units are connected according to the invention by one or more film strips is advantageous in a number of respects. In particular, the connected sharpener bodies can be produced easily and cost-effectively in a single operation, in particular by injection molding, a high level of flexibility as far as the subsequent use of the sharpener units is concerned being ensured at the same time. It is thus possible for the sharpener units to be easily separated in a following step and used as individual sharpeners with or without a shaving-collecting housing. According to an advantageous variant, provision is made, as an alternative, to use the sharpener units in the connected state as a multiple sharpener, the structural unit which is formed from the sharpener units preferably being inserted as a whole into a common shaving-collecting housing. The film strips here make it possible for the structural unit which is formed from the sharpener units to be folded and thus for the sharpener units to be inserted into the shaving-collecting housing in a state in which they have been tilted in relation to one another, in which case one and the same sharpener-unit-containing structural units can be adapted extremely easily to a multiplicity of different shapes of housing. The self-stabilizing assembly of sharpener units here makes it possible, in particular, to realize particularly compact and straightforwardly designed shapes of housing and to install the sharpener units in the shaving-collecting housing in a manner which is easy to implement.

In order to realize a very compact multiple sharpener, or multi-sharpener, sharpener units are expediently folded in the same direction in relation to one another, so that the structural unit approximately forms the outline of a polygon or polygon segment in cross section. In a particularly compact and stable variant, the sharpener units here are folded up to form a regular polygon—that is to say, in the case of three interlinked sharpener units, to form an equilateral triangle.

As an alternative to this, provision is made for folding the sharpener units alternately in opposite directions in relation to one another, so that the structural unit approximately forms a "zigzag line" in cross section. This is particularly advantageous in order to adapt the structural unit to flat shapes of housing of different widths.

In a particularly advantageous form of the pencil sharpener, each sharpener body comprises a guide sleeve with a bore which defines a pencil-guiding channel for a pencil which is to be sharpened, there being integrally formed on the outer periphery of this guide sleeve at least one supporting wing, which is flat (in comparison with the external diameter of the guide sleeve) and projects approximately radially from the guide sleeve in cross section, i.e. as seen along the axis of the pencil-guiding channel of one of the sharpener units). Adjacent sharpener units here are connected to one another at the adjacent outer edges of a respective supporting wing. In this configuration, the sharpener body of each sharpener unit is reduced to the bare essentials, so that, while maintaining a high level of stability in relation to the torsional forces occurring during the sharpening operation, the sharpener body is nevertheless realized in a particularly material-saving manner. At the same time, the above-described shaping allows particularly compact folding of the sharpener units.

Each sharpener body preferably comprises two supporting wings which are integrally formed on the guide sleeve in opposite directions to one another, so that each sharpener body approximately assumes the shape of a wing nut, as seen in cross section through the guide sleeve. In an expedient development, the two supporting wings are joined together in an end region which is spaced apart from the guide sleeve, so that the supporting wings, with the guide sleeve, form a closed supporting frame which is particularly advantageous in terms of stability.

It is preferable for the guide sleeve for the different sharpener units of the same structural unit to be configured differently in each case, so that the pencil-guiding channels, which are defined by the bore of the respective guide sleeve, differ in terms of their diameter and/or of the cone angle of their respective sharpening cone. As an alternative, or in addition, provision is made for the various sharpener units to differ in the way in which a core former assigned to the respective sharpener unit is embodied.

For example, the structural unit comprises three sharpener units, of which a first sharpener unit does not have any core former, while the second and third sharpener units are assigned core formers which round the pencil tip to different degrees.

According to a second variant of the invention, a body of the pencil sharpener comprises a guide sleeve with a bore which defines a pencil-guiding channel for a pencil which is to be sharpened, there being integrally formed on the outer periphery of this guide sleeve at least one supporting wing, which is flat (in comparison with the external diameter of the guide sleeve). The or each supporting wing projects approximately radially from the guide sleeve in cross section and, in an end region which is spaced apart from the guide sleeve, bears a functional element for protecting or for working on the core tip of the pencil which is to be sharpened. The functional element is, in particular, a core former.

According to the invention, the or each supporting wing has incorporated in it a film strip which acts as a predetermined bending point or predetermined separating point and along which the end region of the supporting wing can be bent such that the functional element is moved away from a position in which it engages with the pencil-guiding channel.

A handling-related advantage is achieved by the bendable supporting wing in that the pencil sharpener can be used optionally with or without a functional element and, if required, can be converted by a simple bending operation. This handling flexibility is achieved with a simultaneously extremely simple design, as a result of which the pencil sharpener can be produced particularly easily and cost-effectively—in particular in relation to conventional pencil sharpeners with similar functions.

The film strip may be designed such that the end region of the supporting wing is irreversibly detached from the rest of the supporting wing during bending. However, the film strip preferably acts in the manner of a film hinge and allows reversible and repeated pivoting of the end region, and thus of the functional element arranged thereon, out of and into the engagement position.

It is also the case in the above-described variant of the pencil sharpener that two supporting wings are preferably provided, these projecting in opposite directions to one another from the guide sleeve and giving the sharpener body a wing-nut-like shape, as seen in cross section through the guide sleeve. The supporting wings are preferably brought together, once again, in their end region to form a closed supporting frame.

According to both variants of the pencil sharpener, the bore, which defines the pencil-guiding channel of the or of each sharpener body, passes all the way through the associated guide sleeve, so that the pencil-guiding channel projects beyond the two axial ends of the guide sleeve. In other words, the guide sleeve is designed such that a pencil which has been pushed into the sharpening position passes right through the guide sleeve and at least part of the pencil tip projects out beyond the guide sleeve through an outlet end of the bore. In this configuration, a blade holder is expediently integrally formed on the guide sleeve, this blade holder projecting axially beyond the outlet end of the bore provided in the guide sleeve. The blade holder flanks the pencil-guiding channel on one side here, so that the pencil-guiding channel is open toward a side which is directed away from the blade holder. The, for the most part, open configuration of the pencil-guiding channel in the region of the blade holder, and thus, with a pencil pushed in, in the region of the pencil tip, has the advantage of it being possible for core substance which is shaved off during the sharpening operation to drop off particularly easily from the blade holder. This particularly effectively counteracts a problem, which is typical of cosmetic pencils in particular, where the core substance, which in these pencils is usually soft and plastic, forms sticky clumps on the blade holder during the sharpening operation and smears over the pencil as sharpening continues.

Other features which are considered as characteristic for the invention are set forth in the appended claims.

Although the invention is illustrated and described herein as embodied in a pencil sharpener, it is nevertheless not intended to be limited to the details shown, since various modifications and structural changes may be made therein without departing from the spirit of the invention and within the scope and range of equivalents of the claims.

The construction of the invention, however, together with additional objects and advantages thereof will be best understood from the following description of the specific embodiment when read in connection with the accompanying drawings.

DESCRIPTION OF THE PREFERRED EMBODIMENTS

Figure 1:
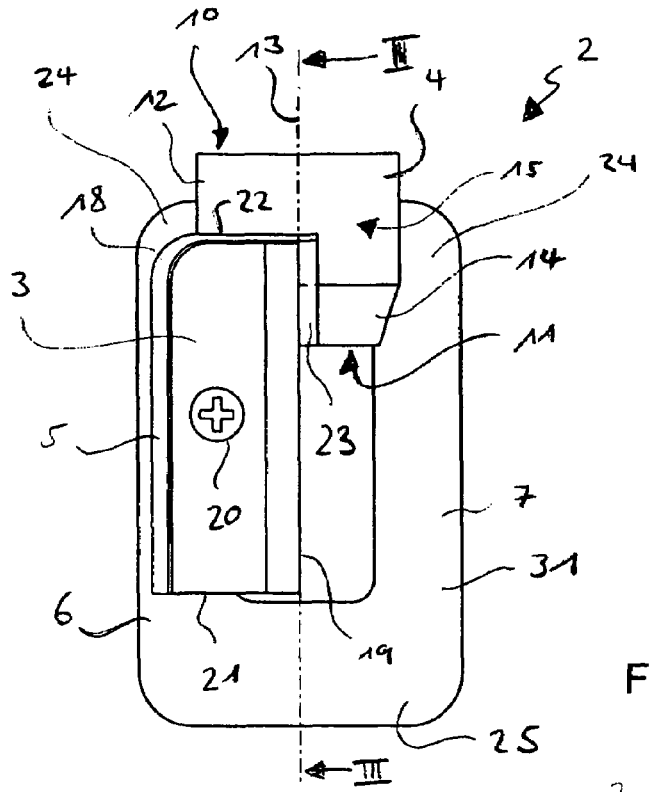
FIG. 1 is a plan view of one design principle of a sharpener body having a guide sleeve, a blade holder integrally formed thereon, and having two supporting wings which are integrally formed on the guide sleeve and are connected to one another to form a supporting frame.

Referring now to the figures of the drawing in detail, a common design principle for a sharpener body 2 is realized in the embodiments of the pencil sharpener 1 according to the invention which are described hereinbelow (in relation to FIGS. 4-9), and this design principle will be described in more detail first of all in general terms with reference to FIGS. 1-3.

FIG. 1 shows the sharpener body 2, which is produced from plastic or metal, and a shaving blade 3, which is fastened on the sharpener body 2. The sharpener body 2, in turn, comprises a guide sleeve 4, a blade holder 5 integrally formed thereon, and two supporting wings 6 and 7 integrally formed on the guide sleeve 4.

Figure 3:
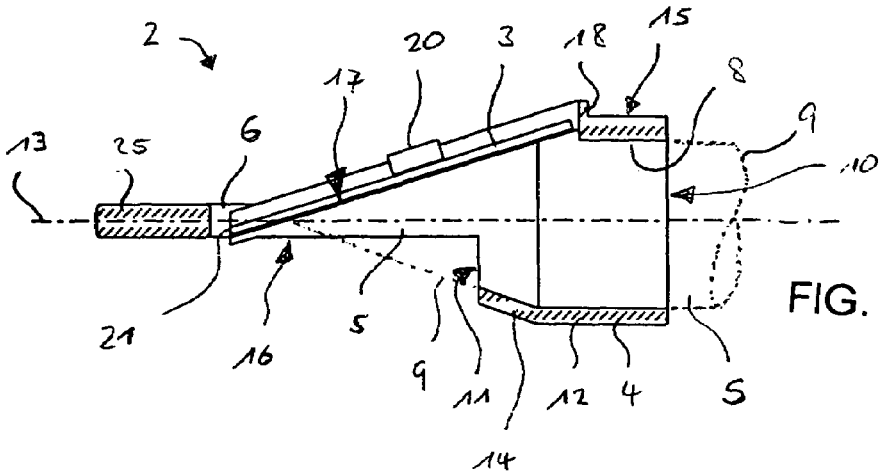
FIG. 3 is a schematic side view of a longitudinal section through the sharpener of FIG. 1, taken along the line III-III in FIG. 1.

The guide sleeve 4 has a central bore 8 (FIG. 3) passing through it, which, during the sharpening operation, bears a pencil S which is to be sharpened, and thus defines a pencil-guiding channel 9 (FIG. 3). The pencil-guiding channel 9 thus refers to the volume which the pencil S which is to be sharpened takes up, in the sharpening position, inside and outside the guide sleeve 4. Outside the guide sleeve 4, the pencil-guiding channel 9 here is formed by the imaginary extension of the wall of the bore 8 beyond the guide sleeve 4. The guide sleeve 4 and, in particular, the bore 8 thereof have an introduction end 10, at which a pencil S which is to be sharpened can be introduced into the bore 8 during the sharpening operation. That end of the guide sleeve 4, and of the bore 8 thereof, which is axially opposite the introduction end 10, and in relation to which the tip of the pencil S projects out of the guide sleeve 4 again in the sharpening position, is referred to as the outlet end 11.

In a portion 12 of the guide sleeve 4 which is adjacent to the introduction end 10, the bore 8 is of cylindrical configuration, i.e. it is configured, in particular, with a constant diameter. This cylindrical portion 12 serves for ensuring good guidance of the pencil S along an axis 13 of the pencil-guiding channel 9. In a portion 14 of the guide sleeve 4 which is adjacent to the outlet end 11, in contrast, the bore 8 tapers conically in the direction of the outlet end 11. This conical portion 14 of the bore 8 serves as a stop for fixing the pencil S axially in the sharpening position.

The outer periphery 15 of the guide sleeve 4 can be configured basically as desired. In the exemplary embodiments illustrated, however, the outer periphery 15 of the guide sleeve 4 is always configured to be circular.

Figure 2:
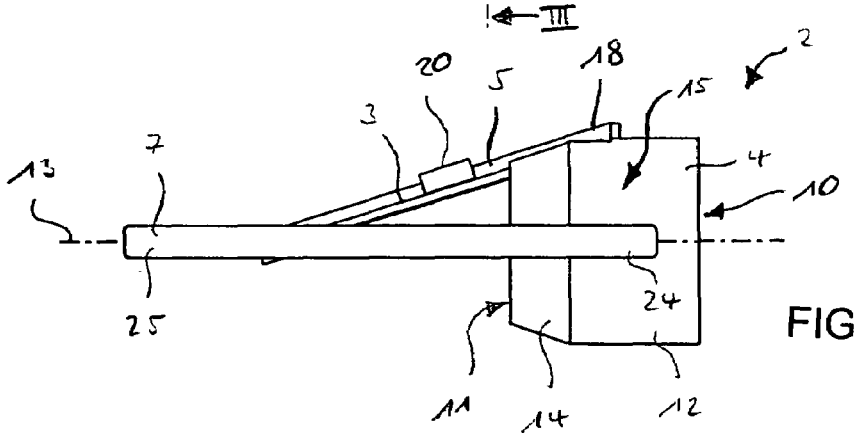
FIG. 2 shows a schematic side view of the sharpener illustrated in FIG. 1.

As can be gathered from FIGS. 2 and 3 in particular, the blade holder 5 is essentially in the form of a wedge, of which the horizontal surface 16 (FIG. 3) is oriented parallel to the axis 13 of the pencil-guiding channel 9, at a small distance therefrom. The sloping surface of the wedge shape, in contrast, forms a bearing surface 17 (FIG. 3), on which the shaving blade 3 is positioned at an angle in relation to the axis 13. For this purpose, the bearing surface 17 is enclosed, in particular at its border which is directed away from the axis 13, by a railing-like positioning aid 18, against which the shaving blade 3 is positioned. The shaving blade 3, in this position, is oriented such that its cutting edge 19 forms a line which approximately intersects the axis 13. The shaving blade 3 is fixed on the bearing surface 17 by means of a fastening screw 20.

The blade holder 5 has its longitudinal center axis arranged offset from, and parallel to, the axis 13, so that its wedge tip 21 is directed away from the guide sleeve 4 and the wedge base 22, which is opposite the wedge tip 21, is correspondingly directed toward the guide sleeve 4. In the region of the wedge base 22, the blade holder 5 overlaps with the guide sleeve 4 in an axial region which exceeds the axial length of the conical portion 14 of the guide sleeve 4. As a result of this overlapping, the pencil S is neatly shaved to its outer periphery. In the overlapping region, the guide sleeve 4 is provided with a shaving-discharge slot 23, into which the cutting edge 19 of the shaving blade 3 projects.

Over most of the region of its axial extent, the blade holder 5 projects beyond the outlet end 11 of the guide sleeve 4. In this region, the blade holder 5 flanks the pencil-guiding channel 9 just on one side, while the pencil-guiding channel 9 is not bounded in the outward direction over the rest of the circumferential-angle region, so that, during the sharpening operation, the shaving blade 3 and the pencil S filling the pencil-guiding channel 9 hang more or less freely in space. In specific terms, the pencil-guiding channel 9 is enclosed by the blade holder 5 and the shaving blade 3 merely over a circumferential-angle region of slightly more than 90°. Over most of the circumferential-angle region of approximately 250°-270°, in contrast, the pencil-guiding channel 9 is open in the outward direction, so that shaving waste and shaved-off core substance can readily drop off from the shaving blade 3 and the blade holder 5.

Each supporting wing 6 and 7 is integrally formed, in an initial region 24, on the outer periphery 15 of the guide sleeve 4 and, from there, projects radially from the guide sleeve 4—as seen in cross section along the axis 13. The two supporting wings 6 and 7 here are arranged, in particular, on mutually opposite circumferential regions of the guide sleeve 4, so that the sharpener body 2 is approximately in the form of a wing nut.

Each supporting wing 6, 7 is of small thickness, in comparison with the diameter of the guide sleeve 4, and is of elongate, flat form, of which the longitudinal extent is oriented parallel to the axis 13. Starting from the initial region 24, each supporting wing 6, 7 extends axially in the direction of the outlet end 11 and beyond the latter. The supporting wings 6, 7 thus flank the blade holder 5 and the shaving blade 3 in the axial direction. The blade holder 5 here is optionally integrated in the supporting wing 7.

In an end region 25, which is arranged opposite the initial region 24, the supporting wings 6, 7 are brought together and connected integrally to one another. The supporting wings 6, 7 thus form an essentially rectangular, closed supporting frame 31, in which the guide sleeve 4 and, if appropriate, also the blade holder 5 are integrated.

According to FIGS. 4 to 7, a first embodiment of the pencil sharpener 1 according to the invention comprises three sharpener units 30, 31 and 32 each with a sharpener body 2 and a shaving blade 3 fastened thereon, of which each sharpener unit 30, 31, 32 is based on the design principle described above. The sharpener units 30, 31 and 32 are provided for sharpening pencils S of different thicknesses and, accordingly, differ in terms of the diameter of the respective guide sleeve 4—as can be seen from FIG. 5—and also, in particular, in terms of the diameter of the bore 8 which is made in the guide sleeve 4 in each case.

The sharpener bodies 2 of the sharpener units 30, 31, 32 are lined up in a row parallel to one another such that the supporting wing 7 of the sharpener unit 30 and the supporting wing 6 of the sharpener unit 31 as well as the supporting wing 7 of the sharpener unit 31 and the supporting wing 6 of the sharpener unit 32 have their respective outer edges 33 (FIG. 5) located one beside the other. The adjacent sharpener units 30, 31 and 31, 32 here are connected in each case by a thin film strip 34 (FIG. 5), which is positioned between the outer edges 33 of the respectively abutting supporting wings 6, 7.

Figure 4:
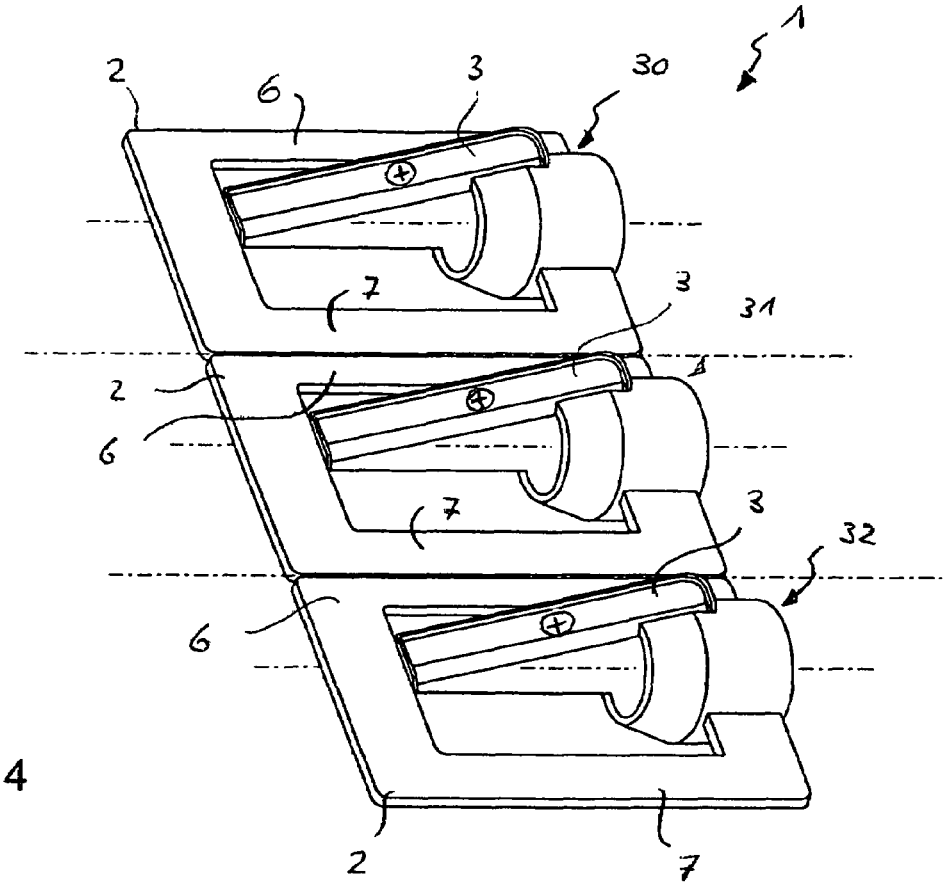
FIG. 4 is a perspective view of an exemplary embodiment of a first variant of the pencil sharpener according to the invention, having three sharpener units which are based on the design principle according to FIGS. 1 to 3 and are connected integrally to one another via film strips acting as a predetermined separating point or predetermined bending point.
Figure 5:
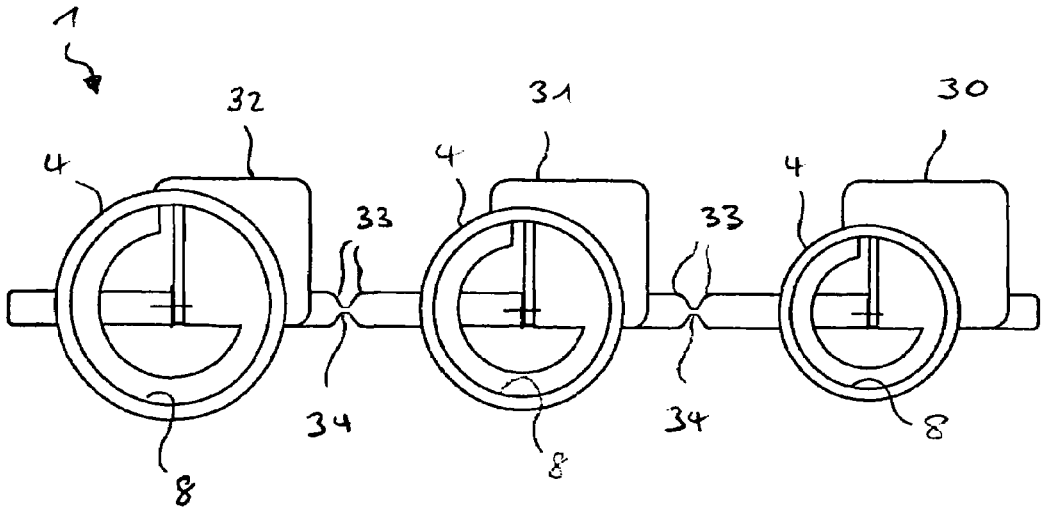
FIG. 5 is a front view of the pencil sharpener assembly according to FIG. 4.

In the unaltered state illustrated in FIGS. 4 and 5, the sharpener units 30, 31 and 32 are oriented in a colinear manner in relation to the plane defined by their supporting wings 6, 7, and they are interlinked via the film strips 34.

Figure 6:
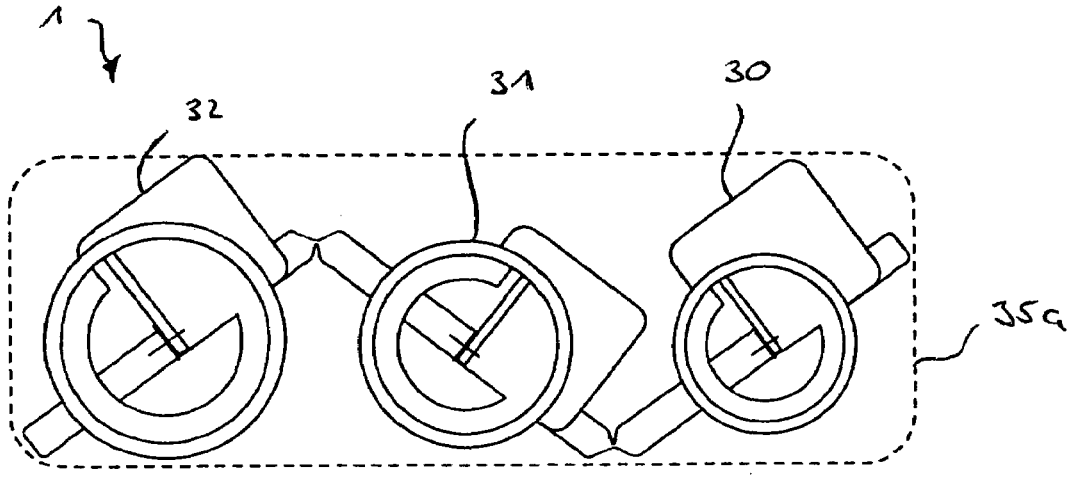
FIG. 6 is an end view of the pencil sharpener assembly of FIG. 4, illustrated similar to FIG. 5, with the sharpener units being folded alternately in opposite directions in relation to one another along the film strips in order to be inserted into a shaving-collecting housing.
Figure 7:
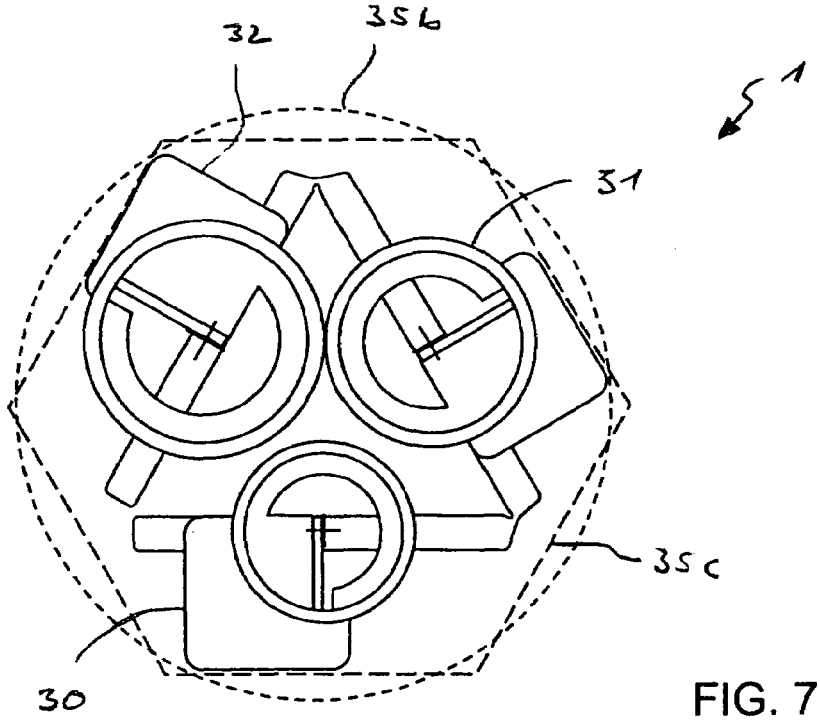
FIG. 7 shows the pencil sharpener assembly from FIG. 4, illustrated as in FIG. 5, with the sharpener units being folded in the same direction in relation to one another along the film strips in order to be inserted into a shaving-collecting housing.

On the one hand, then, the pencil sharpener 1 can be used in this unaltered state. On the other hand, the pencil sharpener 1 can also be separated or folded along the film strips 34 in order for the individual sharpener units 30, 31, 32 to be used separately from one another or for the sharpener units 30, 31, 32 to be inserted in a space-saving manner into a shaving-collecting housing 35*a*, 35*b*, 35*c* (FIGS. 6 and 7). In the former case, the film strips 34 act as a predetermined separating location along which the sharpener units 30, 31, 32 can easily be cut or torn off. In the latter case, the film strips 34, in the manner of a film hinge, act as a predetermined bending point, which allows the sharpener units 30, 31 and 32 to be tilted in relation to one another in a reversible manner, without being destroyed.

The folding capability of the subassembly formed from the interlinked sharpener units 30, 31 and 32 makes it possible for this subassembly to be flexibly adapted as a whole to shaving-collecting housings 35*a*, 35*b*, 35*c* of different shapes.

FIG. 6 shows the sharpener units 30, 31, 32 folded in adaptation to a flat housing 35*a*. The sharpener units 30, 31, 32 here are folded alternately in opposite directions, i.e. in a "zigzag" manner, in relation to one another.

In an alternative arrangement of the sharpener units 30, 31, 32 according to FIG. 7, these sharpener units have been folded up approximately to form an equilateral triangle in cross section (the units thus being folded, in particular, in the same direction as one another). This very compact folding is suitable in particular—as is indicated in FIG. 7—in order to insert the sharpener units 30, 31, 32 into a shaving-collecting housing 35*b* of round cross section or a shaving-collecting housing 35*c* of hexagonal cross section.

As can be gathered from FIGS. 6 and 7, the interlinked sharpener units 30, 31, 32 stabilize themselves in the shapes of housing illustrated, so that there is no absolute need for additional fastening means, e.g. latching hooks, stop surfaces, etc., on the inner wall of the respective shaving-collecting housing 35*a*, 35*b*, 35*c* for the purpose of fixing the sharpener units 30, 31, 32. The shaving-collecting housing 35*a*, 35*b*, 35*c* can thus be realized extremely easily and cost-effectively. Such fastening means however may nevertheless be provided as an option for improved fixing of the sharpener units 30, 31, 32.

Figure 8:
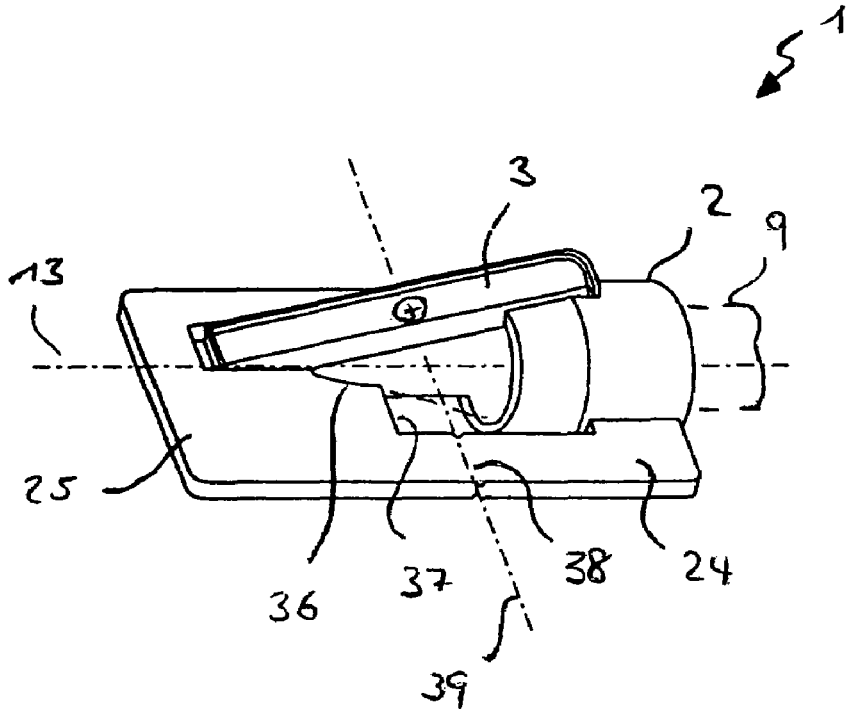
FIG. 8 is a perspective view of an exemplary embodiment of a second variant of the pencil sharpener according to the invention, having a sharpener body which is based on the design principle according to FIGS. 1 to 3, there being provided within the supporting wings a respective film strip which acts as a predetermined separating point or predetermined bending point and along which it is possible to bend an end region of the supporting wings which is directed away from the guide sleeve.
Figure 9:
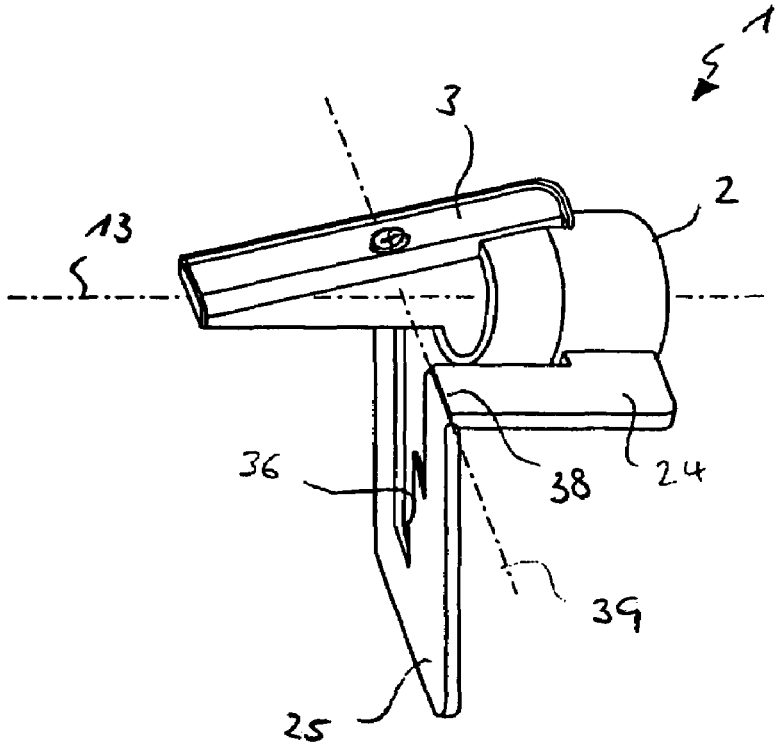
FIG. 9 shows the pencil sharpener from FIG. 8 illustrated as in FIG. 8, the end region of the supporting wings being bent in relation to the position which is illustrated in FIG. 8.

In a second variant, the pencil sharpener 1 according to FIGS. 8 and 9 comprises a sharpener body 2, which is likewise based on the above-described design principle, and a shaving blade 3 fitted thereon. In this configuration, the sharpener body 2 additionally comprises a core former 36, which is realized by a rounded contour of the inner border 37 of the supporting wings 6, 7 in the common end region 25 of the latter. The core former 36 is arranged such that, when the supporting wings 6 and 7 are oriented in a planar manner, it engages in the cone tip of the pencil-guiding channel 9, so that the core of the pencil S which has been pushed into the sharpening position is formed into a rounded tip.

In order for it to be possible to move the core former 36 away from this engagement position if required, the end region 25 of the supporting wings 6 and 7 can be pivoted in a reversible manner, in relation to the respective initial region 24, into the position which is illustrated in FIG. 9. The pivoting capability of the supporting wings 6, 7 is made possible, once again, by a film strip 38, which is incorporated in each of the supporting wings 6 and 7. The film strips 38 assigned to the supporting wings 6 and 7 are oriented along a common axis 39, which is arranged perpendicularly to the axis 13 of the pencil-guiding channel 9 and acts as an axis of rotation for tilting the end region 25.

The film strip 38 is optionally designed to be of such a strength that (in particular in the case of just slight tilting from the starting position according to FIG. 8) it acts in the manner of a leaf spring which forces back the end region 25, and thus the core former 36, elastically into the starting position as soon as the end region 25 is relieved of loading, i.e. as soon as the tilting pressure to which the end region 25 is subjected is removed.

I claim:

1. A pencil sharpener, comprising:

at least one sharpener body formed with at least one film strip defining a predetermined bending or separating point configured to enable at least one of the following:

at least one part of said sharpener body can be bent;

at least one part of said sharpener body can be detached;

one sharpener body can be bent relative to another said sharpener body;

one sharpener body can be detached from another said sharpener body;

wherein said at least one sharpener body is at least two sharpener units each with a sharpener body and a shaving blade fastened thereon, and said sharpener bodies of adjoining said sharpener units are integrally connected via a film strip defining a predetermined bending point and/or predetermined separating point.

2. The pencil sharpener according to claim 1, wherein said sharpener body of each said sharpener unit comprises a guide sleeve with a bore defining a pencil-guiding channel for a pencil to be sharpened, and at least one substantially flat supporting wing projecting approximately radially in cross section from said guide sleeve, and wherein mutually opposite outer edges of said supporting wings of adjoining sharpener bodies are integrally connected in each case by a film strip acting as a predetermined bending point and/or predetermined separating point.

3. The pencil sharpener according to claim 2, wherein said pencil-guiding channels, each defined by a respective said bore, for different said sharpener units, have mutually different diameters and/or, in a region assigned to a pencil tip, mutually different cone angles.

4. The pencil sharpener according to claim 2, which further comprises two supporting wings projecting radially in mutually opposite directions from said or each said guide sleeve, and wherein said supporting wings are connected to one another, to form a supporting frame, in an end region spaced apart from said guide sleeve.

5. The pencil sharpener according to claim 2, wherein each said sharpener body includes a blade holder integrally formed on said guide sleeve and projecting axially beyond an outlet end of said bore formed in said guide sleeve, and wherein said blade holder flanks said pencil-guiding channel on one side, and said pencil-guiding channel is open toward a side directed away from said blade holder.

6. The pencil sharpener according to claim 1, which further comprises a shaving-collecting housing, and wherein said sharpener units are inserted in said housing in an interconnected state.

7. The pencil sharpener according to claim 6, wherein said interconnected sharpener units are inserted into said shaving-collecting housing in a folded state, with said sharpener units pivoted relative to one another.

8. The pencil sharpener according to claim 7, wherein said sharpener units are folded in a common direction.

9. The pencil sharpener according to claim 8, wherein said sharpener units are folded to substantially form a regular polygon in cross section.

10. The pencil sharpener according to claim 9, wherein said regular polygon is a triangle.

11. The pencil sharpener according to claim 7, wherein said sharpener units are folded alternately in opposite directions.

12. A pencil sharpener, comprising:

at least one sharpener body formed with at least one film strip defining a predetermined bending or separating point configured to enable at least one of the following:

at least one part of said sharpener body can be bent;

at least one part of said sharpener body can be detached;

one sharpener body can be bent relative to another said sharpener body;

one sharpener body can be detached from another said sharpener body;

a shaving blade fastened to said sharpener body, said sharpener body including a guide sleeve with a bore defining a pencil-guiding channel for receiving a pencil to be sharpened, and at least one flat supporting wing projecting substantially radially in cross section from said guide sleeve; said supporting wing having an end region, directed away from said guide sleeve, with a functional element for protecting or for working on a tip of the pencil to be sharpened, and wherein said or each said supporting wing is bendable along a film strip defining a predetermined bending point or predetermined separating point, and said functional element is movable away from a position in which said functional element engages with said pencil-guiding channel.

13. The pencil sharpener according to claim 12, wherein said film strip is a film hinge enabling said functional element to be pivoted reversibly out of the engagement position and into the engagement position.

14. A pencil sharpener, comprising a plurality of interlinked sharpener bodies formed with at least one film strip defining a predetermined bending or separating point enabling one of said sharpener bodies to be bent relative to another of said sharpener bodies or detached and separated from another of said sharpener bodies, a plurality of sharpener units each including a a respective one of said sharpener bodies and having a shaving blade fastened thereon, and wherein said sharpener bodies of adjacent said sharpener units are integrally connected to one another via a film strip defining a predetermined bending point and/or predetermined separating point.

15. The pencil sharpener according to claim 14, wherein each said sharpener body of each said sharpener unit includes a guide sleeve with a bore defining a pencil-guiding channel for a pencil to be sharpened, and at least one flat supporting wing projecting approximately radially in cross section from said guide sleeve, and wherein mutually opposite outer edges of said supporting wings of adjacent said sharpener bodies are integrally connected in each case by a film strip acting as a predetermined bending point and/or predetermined separating point.

* * * * *